US010959533B2

(12) United States Patent
Liang et al.

(10) Patent No.: US 10,959,533 B2
(45) Date of Patent: Mar. 30, 2021

(54) ADJUSTABLE BED WITH DUAL-TILT ADJUSTABLE FOUNDATION

(71) Applicant: ASCION, LLC, Bloomfield Hills, MI (US)

(72) Inventors: Qianyu Liang, Auburn Hills, MI (US); Martin B. Rawls-Meehan, Birmingham, MI (US)

(73) Assignee: ASCION, LLC, Bloomfield Hills, MI (US)

( * ) Notice: Subject to any disclaimer, the term of this patent is extended or adjusted under 35 U.S.C. 154(b) by 102 days.

(21) Appl. No.: 16/117,877

(22) Filed: Aug. 30, 2018

(65) Prior Publication Data

US 2019/0069687 A1 Mar. 7, 2019

Related U.S. Application Data

(60) Provisional application No. 62/553,361, filed on Sep. 1, 2017.

(51) Int. Cl.

| | |
|---|---|
| ***A47C 20/04*** | (2006.01) |
| ***A61G 7/015*** | (2006.01) |
| ***A47C 17/86*** | (2006.01) |
| ***A47C 20/08*** | (2006.01) |
| ***A47C 19/04*** | (2006.01) |
| *A61G 7/018* | (2006.01) |
| *A47C 19/02* | (2006.01) |

(52) U.S. Cl.

CPC ..... *A47C 20/041* (2013.01); *A47C 17/86* (2013.01); *A47C 19/045* (2013.01); *A47C 20/08* (2013.01); *A61G 7/015* (2013.01); *A47C 19/021* (2013.01); *A61G 7/018* (2013.01); *A61G 2203/12* (2013.01)

(58) Field of Classification Search

CPC ..... A47C 20/041; A47C 20/08; A47C 17/86; A47C 19/045; A47C 19/021; A61G 7/015; A61G 7/018; A61G 2203/12

See application file for complete search history.

(56) References Cited

U.S. PATENT DOCUMENTS

| | | | | |
|---|---|---|---|---|
| 4,435,862 | A * | 3/1984 | King | A61G 7/015 318/467 |
| 6,611,979 | B2 * | 9/2003 | Welling | A61G 7/0528 5/624 |
| 7,036,165 | B2 * | 5/2006 | Weinman | A47C 20/041 5/617 |
| 7,093,312 | B2 * | 8/2006 | Mossbeck | A47C 20/041 5/600 |
| 7,296,312 | B2 * | 11/2007 | Menkedick | A61B 5/1115 5/611 |
| 7,321,811 | B1 | 1/2008 | Rawls-Meehan | |
| 7,465,280 | B2 | 12/2008 | Rawls-Meehan | |

(Continued)

*Primary Examiner* — Robert G Santos
*Assistant Examiner* — Rahib T Zaman
(74) *Attorney, Agent, or Firm* — Marshall, Gerstein & Borun LLP

(57) ABSTRACT

The disclosure generally relates to an adjustable foundation or bed, in particular having a dual-tilt adjustable foundation. Upper and lower segments of the adjustable foundation subframe are rotatable relative to each other, thus allowing the upper portion of the subframe to tilt and assume an inclined, flat/horizontal, or declined position relative to the lower portion of the subframe. An articulating mattress support surface above the subframe can move independently from the tilting subframe.

9 Claims, 3 Drawing Sheets

(56) References Cited

U.S. PATENT DOCUMENTS

| | | | | |
|---|---|---|---|---|
| 7,779,494 | B2 * | 8/2010 | Poulos | A61G 7/005 5/618 |
| 7,805,785 | B2 | 10/2010 | Rawls-Meehan | |
| 7,849,539 | B2 * | 12/2010 | Hornbach | A61G 7/018 5/610 |
| 7,886,380 | B2 * | 2/2011 | Hornbach | A47C 19/045 5/613 |
| 7,900,302 | B2 * | 3/2011 | Long | A47C 20/08 5/617 |
| 7,930,783 | B2 | 4/2011 | Rawls-Meehan | |
| 7,933,669 | B2 | 4/2011 | Rawls-Meehan | |
| 7,979,169 | B2 | 7/2011 | Rawls-Meehan | |
| 8,019,486 | B2 | 9/2011 | Rawls-Meehan | |
| 8,032,263 | B2 | 10/2011 | Rawls-Meehan | |
| 8,032,960 | B2 | 10/2011 | Rawls-Meehan | |
| 8,046,114 | B2 | 10/2011 | Rawls-Meehan | |
| 8,046,115 | B2 | 10/2011 | Rawls-Meehan | |
| 8,046,116 | B2 | 10/2011 | Rawls-Meehan | |
| 8,046,117 | B2 | 10/2011 | Rawls-Meehan | |
| 8,050,805 | B2 | 11/2011 | Rawls-Meehan | |
| 8,069,512 | B2 | 12/2011 | Rawls-Meehan | |
| 8,078,336 | B2 | 12/2011 | Rawls-Meehan | |
| 8,078,337 | B2 | 12/2011 | Rawls-Meehan | |
| 8,150,562 | B2 | 4/2012 | Rawls-Meehan | |
| 8,375,488 | B2 | 2/2013 | Rawls-Meehan | |
| 8,565,934 | B2 | 10/2013 | Rawls-Meehan | |
| 8,682,457 | B2 | 3/2014 | Rawls-Meehan | |
| 8,752,220 | B2 * | 6/2014 | Soderberg | A61G 7/0527 5/424 |
| 8,959,681 | B2 * | 2/2015 | Richards | A61G 7/00 340/540 |
| 9,687,400 | B2 * | 6/2017 | Bly | A61G 7/002 |
| 10,058,188 | B2 * | 8/2018 | Tarplee | A47C 20/041 |
| 10,231,889 | B2 * | 3/2019 | Johnson | A61G 7/012 |
| 2012/0057685 | A1 | 3/2012 | Rawls-Meehan | |

* cited by examiner

ADJUSTABLE BED WITH DUAL-TILT ADJUSTABLE FOUNDATION

CROSS REFERENCE TO RELATED APPLICATION

Priority is claimed to U.S. Provisional Application No. 62/553,361 (filed Sep. 1, 2017), which is incorporated herein by reference in its entirety.

STATEMENT OF GOVERNMENT INTEREST

None.

BACKGROUND OF THE DISCLOSURE

Field of the Disclosure

The disclosure generally relates to an adjustable foundation or bed, in particular having a dual-tilt adjustable foundation. Upper and lower segments of the adjustable foundation subframe are rotatable relative to each other, thus allowing the upper portion of the subframe to tilt and assume an inclined, flat/horizontal, or declined position relative to the lower portion of the subframe. An articulating mattress support surface above the subframe can move independently from the tilting subframe.

SUMMARY

In one aspect, the disclosure relates to an adjustable foundation 20 (e.g., for an adjustable bed 10 with a mattress 300 thereon) comprising: (a) a mattress support surface 100 having a top surface 112 and an opposing bottom surface, the mattress support surface 100 optionally comprising (i) a first deck support section 110D, and (ii) a second deck support 110C section pivotally attached to the first deck support section 110D; (b) a subframe 230 positioned below the bottom surface of the mattress support surface 100, the subframe 230 comprising (i) an upper subframe support 235 below the bottom surface of the mattress support surface 100, (ii) a lower subframe support 231 below the upper subframe support 235, (iii) a first connector 239A pivotally attached at opposing ends 239$A_1$/$A_2$ to the upper subframe support 235 and the lower subframe support 231, and (iii) a second connector 239B pivotally attached at opposing ends 239$B_1$/$B_2$ to the upper subframe support 235 and the lower subframe support 231; and (c) a subframe actuator 246 having a first end mounted to the upper subframe support 235 and a second opposing end mounted to the lower subframe support 231. The upper subframe support 235 is adapted to tilt between an inclined position, a flat position (e.g., horizontal), and a declined position (e.g., relative to the bottom subframe support 231) when the subframe actuator 246 is activated (e.g., push rod is extended or retracted), causing the first connector 239A to rotate and causing the second connector 239B to rotate (e.g., each rotates about both of its opposing pivotal attachments).

Various refinements of the adjustable bed and foundation are possible.

In a refinement, when the upper subframe support 235 is in a flat position relative to the bottom subframe support 231, the first connector 239A and the lower subframe support 231 together define a first angle $\Theta_1$ therebetween (e.g., relative to center of adjustable foundation), and the second connector 239B and the lower subframe support 231 together define a second angle $\Theta_2$ therebetween (e.g., relative to center of adjustable foundation); and tilting the upper subframe support 235 causes one of the first angle $\Theta_1$ and the second angle $\Theta_2$ to increase and the other to decrease.

In another refinement, the adjustable foundation 20 further comprises a first hinge 212 defining the first lateral pivot axis $P_1$, the first hinge 212 being mounted to the first deck support section 110D and being (pivotally) mounted to the second deck support section 110C; and a second hinge 214 defining the second lateral pivot axis $P_2$, the second hinge 214 being mounted to the second deck support 110C section and being mounted to the third deck support section 110B.

In another refinement, the mattress support surface 100 comprises the first deck support section 110D, and the second deck support section 110C pivotally attached to the first deck support section 110D.

In a further refinement, the first connector 239A further comprises a member 239$A_3$ extending from a body portion of the first connector 239A to a distal end of the member 239$A_3$, the distal end of the member 239$A_3$ being in sliding contact with the first deck support 110D section (e.g., via a roller, track, or other sliding or low-friction connection with the first deck support 110D section directly or indirectly through contact with a first frame support section 210D). The first connector member 239$A_3$ is adapted to raise the first deck support section 110D relative to the upper subframe support 235 when the upper subframe support 235 is tilting toward the inclined position, for example by further rotation relative to the tilting upper subframe support, which conversely will lower the first deck support section when tilting from an inclined position toward a flat position. Between the flat and declined positions, the first connector member can disengage from the first deck support section and does not cause it to independently move.

In a further refinement, the adjustable foundation 20 further comprises a first actuator 240 having a first end mounted to the first deck support section 110D and a second opposing end mounted to the subframe 230 (e.g., to the upper subframe support).

In a further refinement, the first deck support section 110D corresponds to a back and head portion of the mattress support surface 100, and the second deck support section 110C corresponds to a bottom portion of the mattress support surface 100.

In a further refinement, wherein the mattress support surface 110 further comprises a third deck support section 110B pivotally attached to the second deck support section 110C, and a fourth deck support section 110A pivotally attached to the third deck support section 110B. The adjustable foundation 20 can further comprise a first actuator 240 having a first end mounted to the first deck support section 110D and a second opposing end mounted to the subframe 230 (e.g., to the upper subframe support); and a second actuator 240 having a first end mounted to the third deck support section 110B and a second opposing end mounted to the subframe 230 (e.g., to the upper subframe support).

In another refinement, the adjustable foundation 20 further comprises a mattress 300 positioned above the mattress support surface 100.

Additional features of the disclosure may become apparent to those skilled in the art from a review of the following detailed description, taken in conjunction with the drawings, examples, and appended claims.

BRIEF DESCRIPTION OF THE DRAWINGS

For a more complete understanding of the disclosure, reference should be made to the following detailed description and accompanying drawings wherein.

While the disclosed apparatus and methods and are susceptible of embodiments in various forms, specific embodiments of the disclosure are illustrated (and will hereafter be described) with the understanding that the disclosure is intended to be illustrative, and is not intended to limit the claims to the specific embodiments described and illustrated herein.

DETAILED DESCRIPTION

The disclosure generally relates to an adjustable foundation or bed, in particular having a dual-tilt adjustable foundation. Upper and lower segments of the adjustable foundation subframe are rotatable relative to each other, thus allowing the upper portion of the subframe to tilt and assume an inclined, flat/horizontal, or declined position relative to the lower portion of the subframe. An articulating mattress support surface above the subframe can move independently from the tilting subframe.

Figure 1:
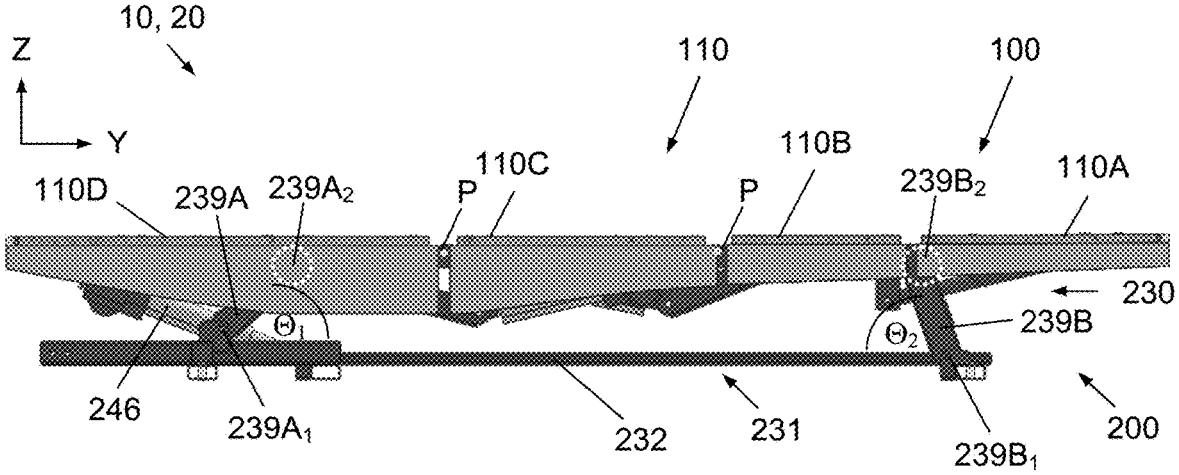
FIG. 1 is a side view of a dual-tilt adjustable foundation in a flat/horizontal subframe position according to the disclosure.
Figure 2:
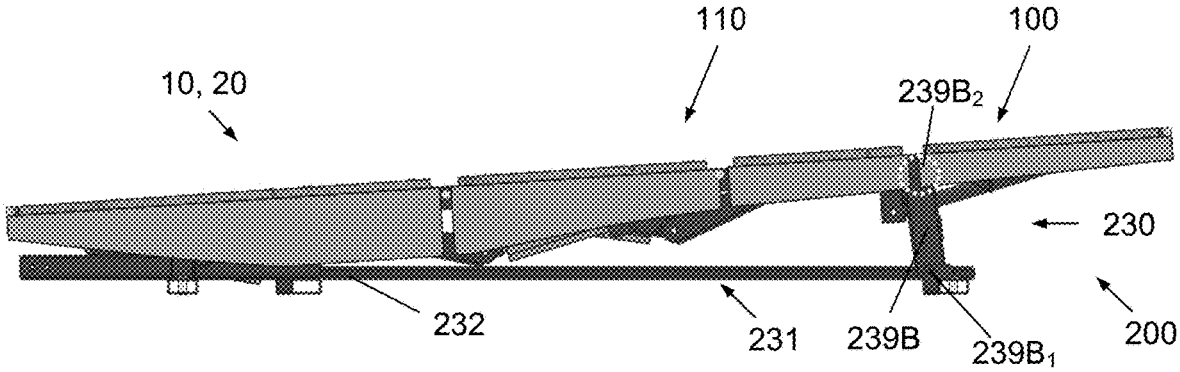
FIG. 2 is a side view of a dual-tilt adjustable foundation in a declined subframe position according to the disclosure.
Figure 3:
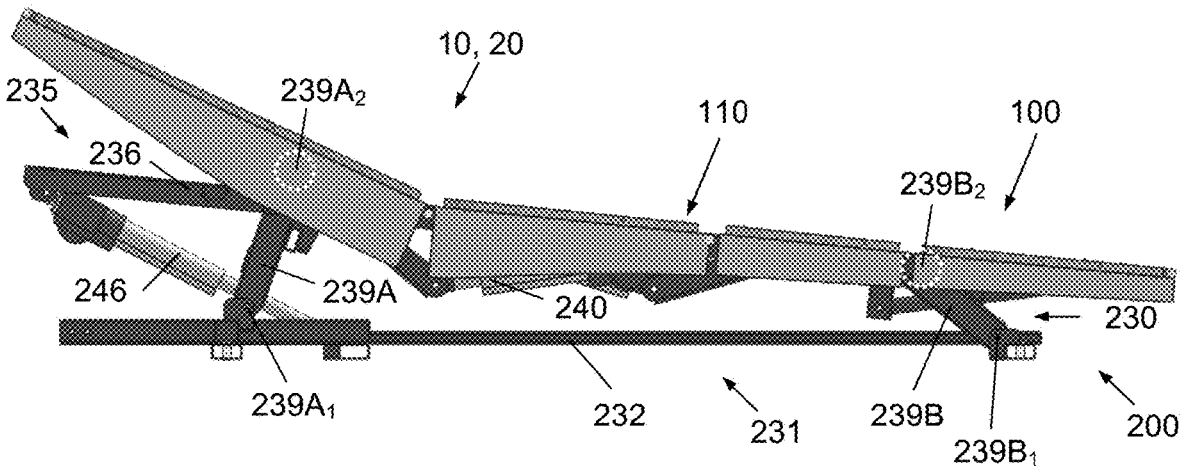
FIG. 3 is a side view of a dual-tilt adjustable foundation in an inclined subframe position according to the disclosure.
Figure 4:
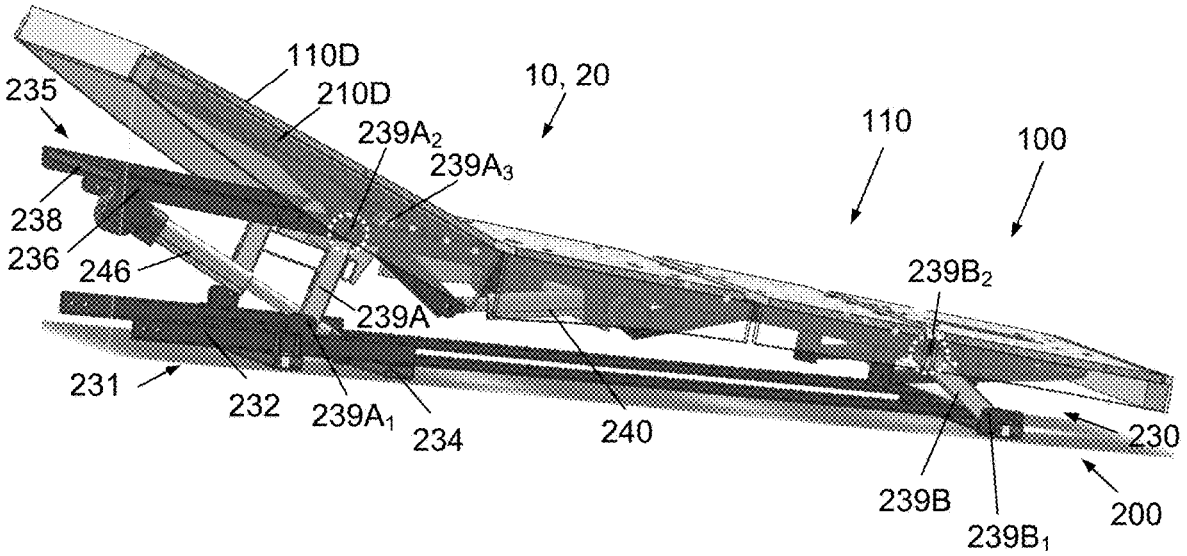
FIG. 4 is a side perspective view of a dual-tilt adjustable foundation in an inclined subframe position according to the disclosure.
Figure 5:
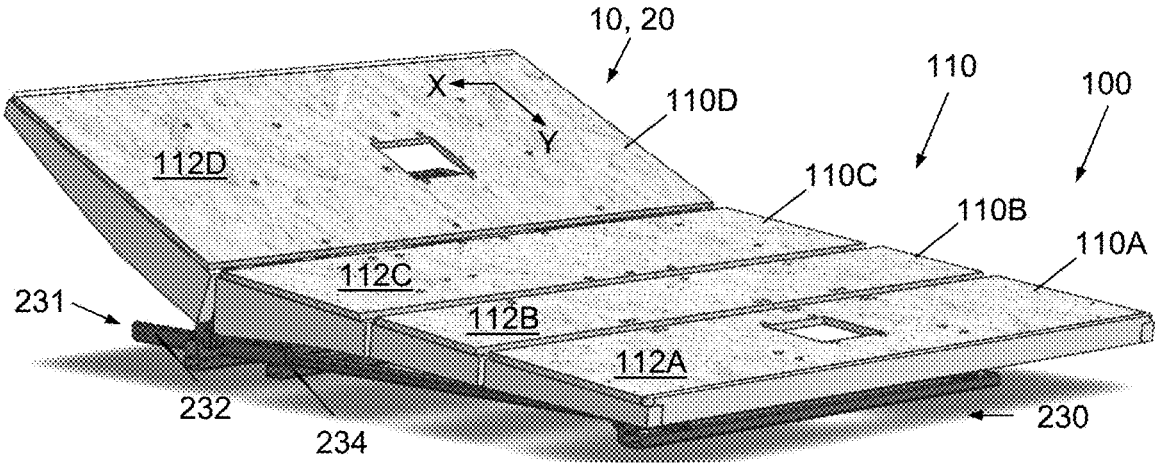
FIG. 5 is a top perspective view of a dual-tilt adjustable foundation in an inclined subframe position according to the disclosure.
Figure 6:
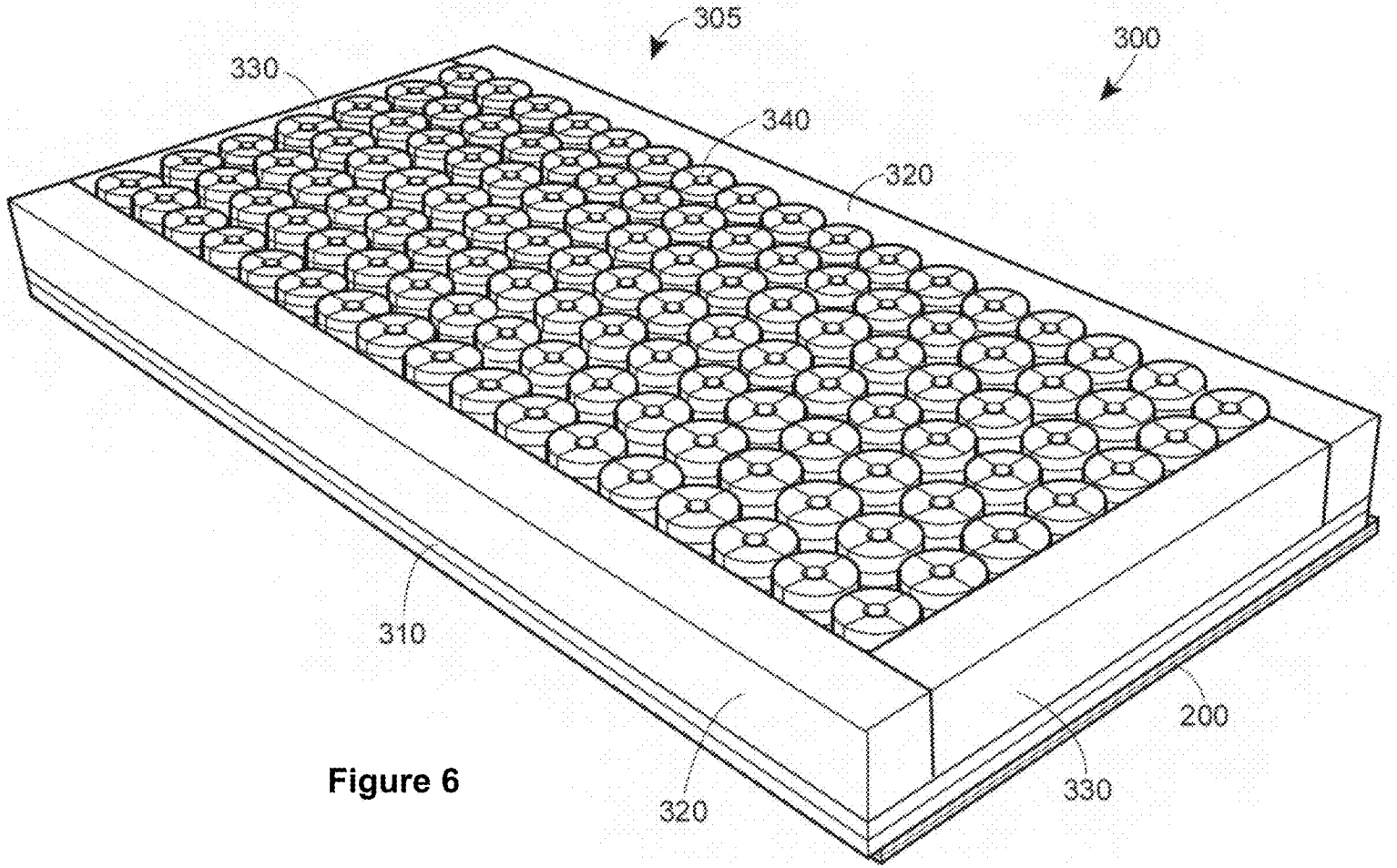
FIG. 6 is a top perspective illustration of a mattress according to the disclosure.

FIGS. 1-6 generally illustrate a dual-tilt adjustable bed 10 or adjustable foundation 20 according to the disclosure. FIG. 1 is a side view of a dual-tilt adjustable foundation 20 in a flat/horizontal subframe position according to the disclosure. The illustrated adjustable foundation 20 can include a mattress support (or deck) 100 mounted to an adjustable frame 200. The adjustable bed 10 further includes a mattress 300 (e.g., as illustrated in FIG. 6 or otherwise, but not shown in FIG. 1) sitting atop the adjustable foundation 20. FIG. 2 is a side view of a dual-tilt adjustable foundation 20 in a declined subframe position according to the disclosure. FIG. 3 is a side view of a dual-tilt adjustable foundation 20 in an inclined subframe position according to the disclosure. FIG. 4 is a side perspective view of a dual-tilt adjustable foundation 20 in an inclined subframe position according to the disclosure. FIG. 5 is a top perspective view of a dual-tilt adjustable foundation 20 in an inclined subframe position according to the disclosure. FIG. 6 is a top perspective illustration of a mattress 300 according to the disclosure.

The adjustable foundation 20 can be a component of an adjustable bed 10 which includes a mattress 300 on the adjustable foundation 20. The adjustable foundation 20 generally includes a mattress support surface 100, a subframe 230 positioned below the bottom surface of the mattress support surface 100, and a subframe actuator 246. The mattress support surface 100 has a top surface 112 and an opposing bottom surface. As illustrated, the mattress support surface 100 can include a first deck support section 110D, and a second deck support 110C section pivotally attached to the first deck support section 110D, for example also including additional deck support sections 110B and 110A likewise pivotally attached to each other in series. The subframe 230 includes (i) an upper subframe support 235 below the bottom surface of the mattress support surface 100, (ii) a lower subframe support 231 below the upper subframe support 235, (iii) a first connector 239A pivotally attached at opposing ends 239$A_1$/$A_2$ to the upper subframe support 235 and the lower subframe support 231, and (iii) a second connector 239B pivotally attached at opposing ends 239$B_1$/$B_2$ to the upper subframe support 235 and the lower subframe support 231. The subframe actuator 246 has a first end mounted to the upper subframe support 235 and a second opposing end mounted to the lower subframe support 231. The upper subframe support 235 is adapted to tilt between an inclined position, a flat position (e.g., horizontal), and a declined position (e.g., relative to the bottom subframe support 231) when the subframe actuator 246 is activated (e.g., push rod is extended or retracted), causing the first connector 239A to rotate and causing the second connector 239B to rotate (e.g., each rotates about both of its opposing pivotal attachments). In the illustrated embodiment, when the upper subframe support 235 is in a flat position relative to the bottom subframe support 231, the first connector 239A and the lower subframe support 231 together define a first angle $\Theta_1$ therebetween (e.g., relative to center of adjustable foundation), and the second connector 239B and the lower subframe support 231 similarly together define a second angle $\Theta_2$ therebetween (e.g., relative to center of adjustable foundation). Tilting the upper subframe support 235 causes one of the first angle $\Theta_1$ and the second angle $\Theta_2$ to increase and the other to decrease.

The mattress support 100 includes a deck support 110 platform, for example including a plurality of deck support sections 110A-110D as illustrated. A deck support platform 110 formed from a plurality of deck support sections 110A-110D, each having a corresponding upper surface 112A-112D (i.e., the surface which supports the mattress 300) is suitable for the adjustable foundation 20. In the illustrated embodiment, section 110A corresponds to the foot portion of the bed, section 110B corresponds to the leg portion of the bed, section 110C corresponds to the bottom portion of the bed, and section 110D corresponds to the head and neck portion of the bed 10/foundation 20 (i.e., where the sections correspond to the body portion of a user laying on the bed 10/mattress 300 in a normal use orientation). Each section 110A-110D includes longitudinally opposed ends 110$A_1$ and 110$A_2$, 110$B_1$ and 110$B_2$, 110$\Theta_1$ and 110$\Theta_2$, 110$D_1$ and 110$D_2$, respectively, where the longitudinal direction Y is generally defined as being perpendicular to the pivot axis P (described below) and/or along the mattress support 100 length or mattress 300 length. Each deck support section 110A-110D can be pivotally attached to one or more adjacent sections (e.g., directly or indirectly via underlying frame 200 structure as described below), thus allowing each section 110A-110D to rotate independently around the lateral pivot axis P (e.g., an axis generally in the lateral direction X and perpendicular to the longitudinal direction Y). The mattress support 100 generally includes at least two deck support sections, for example including a first (foot) support section 110A, a second (leg) support section 110B pivotally attached to the first section 110A, a third (bottom) support section 110C pivotally attached to the second section 110B, and a fourth (head/neck) support section 110D pivotally attached to the third section 110C as shown in FIG. 1. In other embodiments (not shown), the mattress support 100 can have fewer or more support sections (e.g., a first (foot) support section, a second (leg and bottom) support section pivotally attached thereto, and a third (head/neck) support section pivotally attached thereto). In some embodiments the support sections 110A-110D can be formed from a rigid support material such as wood or metal. In other embodiments the support sections 110A-110D can be formed from a flexible fabric or padding material (e.g., alone or in combination with a rigid support material, such as a cover or padding for an underlying rigid support material).

The adjustable frame 200 generally provides the mechanical, electrical, and electronic support and articulation components for the adjustable foundation 20 and bed 10. As illustrated, the adjustable frame 200 includes a frame support 210, for example including a plurality of frame support sections 210A-210D as illustrated and corresponding to the deck support sections 110A-110D. Each deck support section 110A-110D can be fixedly or removably mounted (e.g., via bolts, screws, or other fastener or adhesive components) to its underlying frame support section 210A-210D such that when one or more frame support sections 210A-210D are articulated, the deck support sections 110A-110D are correspondingly articulated. As illustrated, each frame support section 210A-210D can be pivotally attached at a pivot axis P to one or more adjacent sections (e.g., directly as illustrated and providing an indirect pivotal attachment for corresponding deck support sections), thus allowing each section 210A-210D to rotate independently around the lateral pivot axis P. The adjustable frame 200 generally includes at least two frame support sections, for example including a first (foot) support section 210A, a second (leg) support section 210B pivotally attached to the first section 210A, a third (bottom) support section 210C pivotally attached to the second section 210B, and a fourth (head/neck) support section 210D pivotally attached to the third section 210C as shown in FIG. 1. In other embodiments (not shown), the adjustable frame 200 can have fewer or more frame support sections (e.g., a first (foot) support section, a second (leg and bottom) support section pivotally attached thereto, and a third (head/neck) support section pivotally attached thereto).

As illustrated, the adjustable frame 200 further includes a subframe bed frame 230. The subframe 230 can include a rigid, non-articulatable stationary lower subframe support 231 structure which sits on a floor or within a decorative bed frame common in the furniture industry such as a platform bed (e.g., via various leg elements, not shown) and provides stability for the bed foundation 20 as the adjustable frame 200 is articulated to various different positions. The subframe 230 can further include a tiltable, upper subframe support 235 which provides an additional degree of motion for the adjustable frame 200. The adjustable frame 200 can further include one or more support members 220 connecting structure between the subframe 230 and the frame support 210 and sections 210A-210D thereof. In some embodiments, one or more of the frame sections 210A-210D can be fixed in position relative to the subframe 230 (e.g., bottom section 210C as illustrated) and be unable to rotate or articulate relative to the subframe 230, although other frame sections pivotally attached thereto are able to rotate or articulate. As further illustrated, the adjustable frame 200 can include one or more actuators 240 (e.g., a first actuator 240A and a second actuator 240B as shown) variously mounted to one or more of the subframe 230, a support member 220, a frame support section 210A-210D, and a deck support section 110A-110D (e.g., directly mounted thereto or indirectly via the corresponding frame support section 210A-210D). In some embodiments, the subframe 230, the support members 220, and the frame support sections 210A-210D can be formed from metal such as steel. The actuators 240 can be any of those commonly known in the art, such as linear actuators. The actuators 240 and, correspondingly, the configuration or position of the adjustable frame 200, mattress support 100, and mattress 300 can be controlled and adjusted by a suitable power supply 250, an adjustable bed controller 260 (illustrated as a combined unit with the power supply 250; e.g., programmable logic controller or otherwise), and a remote control to deliver repositioning commands (not shown).

The mattress 300 is not particularly limited, and it can be a conventional mattress 300 (e.g., a spring or coil mattress, memory foam mattress, air mattress) with a base 310 (e.g., a continuous fabric material) suitable for use on a mattress support structure such as a fixed bed frame or an adjustable bed frame. In the illustrated embodiment in FIG. 7, the mattress 300 includes a mattress containment frame 305 including a plurality of foam cells (or foam springs) 340 positioned in the frame 305 to provide the sleeping support surface for the mattress. The mattress containment frame 305 includes a lower/bottom base 310, sidewalls 320, and endwalls 330 which generally define the interior frame 305 volume housing the foam cells 340. The sidewalls 320 and endwalls 330 suitably are formed from a foam material. The base 310 can be a generally continuous fabric material (e.g., a non-woven fabric material). The mattress 300 is generally positioned above the mattress support 100 surface 112, for example sitting directly atop the deck support sections 110A-110D. In other embodiments, other structure between the mattress 300 and mattress support 100 surface 112 can be present, for example a padding or cushion material (e.g., which can be continuous or include openings).

Rawls-Meehan U.S. Pat. Nos. 7,321,811, 7,465,280, 7,805,785, 7,930,783, 7,933,669, 7,979,169, 8,019,486, 8,032,263, 8,032,960, 8,046,114, 8,046,115, 8,046,116, 8,046,117, 8,050,805, 8,069,512, 8,078,336, 8,078,337, 8,150,562, 8,375,488, 8,565,934, and 8,682,457 as well as Rawls-Meehan U.S. Publication No. 2012/0057685 are incorporated herein by reference in their entireties and variously disclose mattresses including foam springs or foam cells and materials/configurations therefor, adjustable bed assemblies including adjustable mattress frames, electrical, mechanical, and electronic components associated therewith, and remote controls for use therewith, all of which may be used individually or collectively in combination with the adjustable bed described herein.

Because other modifications and changes varied to fit particular operating requirements and environments will be apparent to those skilled in the art, the disclosure is not considered limited to the example chosen for purposes of illustration, and covers all changes and modifications which do not constitute departures from the true spirit and scope of this disclosure.

Accordingly, the foregoing description is given for clearness of understanding only, and no unnecessary limitations should be understood therefrom, as modifications within the scope of the disclosure may be apparent to those having ordinary skill in the art.

All patents, patent applications, government publications, government regulations, and literature references cited in this specification are hereby incorporated herein by reference in their entirety. In case of conflict, the present description, including definitions, will control.

Throughout the specification, where the compositions, processes, or apparatus are described as including components, steps, or materials, it is contemplated that the compositions, processes, or apparatus can also comprise, consist essentially of, or consist of, any combination of the recited components or materials, unless described otherwise. Component concentrations can be expressed in terms of weight concentrations, unless specifically indicated otherwise. Combinations of components are contemplated to include homogeneous and/or heterogeneous mixtures, as would be understood by a person of ordinary skill in the art in view of the foregoing disclosure.

PARTS LIST

10 adjustable bed (including mattress support 100, adjustable frame 200, and mattress 300)
20 adjustable foundation (including mattress support 100 and adjustable frame 200)
100 mattress support (or deck) surface
110 deck support (sections 110A-D as foot, leg, bottom, and back/head portions; longitudinally opposed ends 110$A_1$ and 110$A_2$, 110$B_1$ and 110$B_2$, 110$\Theta_1$ and 110$\Theta_2$, 110$D_1$ and 110$D_2$)
112 top surface of deck support (sections 112A-D as for deck support)
200 adjustable (bed) frame
210 frame support (sections 210A-D as for deck support)
220 support member
230 subframe or stationary bed frame
231 lower subframe support
232 lower longitudinal support
234 lower lateral support
235 upper subframe support
236 upper longitudinal support (sections 236A-D as for deck support)
238 upper lateral support
239A rotating connector or support bracket/element at/near proximal (e.g., head) end of subframe
239$A_1$ pivotable/rotating connection of connector 239A to lower subframe support 231
239$A_2$ pivotable/rotating connection of connector 239A to upper subframe support 235
239$A_3$ extending member from connector 239A to frame support 210 (e.g., head section 210D) with distal sliding/rolling end for raising/lowering frame support 210/deck support 110 (e.g., head sections 210D, 110D) during tilting
239B rotating connector or support bracket/element at/near distal (e.g., leg or foot) end of subframe
239$B_1$ pivotable/rotating connection of connector 239B to lower subframe support 231
239$B_2$ pivotable/rotating connection of connector 239B to upper subframe support 235
240 actuator or movement/articulation means for deck support/frame support sections
242 first/proximal end of actuator (e.g., winding)
244 second/distal end of actuator (e.g., distal end of push rod)
246 actuator or movement/articulation for subframe sections
250 power supply
260 adjustable bed controller
300 mattress (300A: foot end; 300D: head end)
305 containment frame
310 base
320 sidewalls
330 endwalls
340 foam cells or foam springs
D vertical distance
P pivot axis
X lateral direction
Y longitudinal direction
Z vertical/normal direction
$\Theta$ angle of articulation between adjacent sections
$\Theta_1$ angle of articulation or tilt between lower subframe support and connector 239A (relative to center of adjustable frame)
$\Theta_2$ angle of articulation or tilt between lower subframe support and connector 239B (relative to center of adjustable frame)

What is claimed is:

1. An adjustable foundation comprising:
(a) a mattress support surface having a top surface and an opposing bottom surface;
(b) a subframe positioned below the bottom surface of the mattress support surface, the subframe comprising (i) an upper subframe support below the bottom surface of the mattress support surface, the upper subframe support comprising a rigid upper longitudinal support extending longitudinally from a head portion of the subframe to an opposing foot portion of the subframe, (ii) a lower subframe support below the upper subframe support, the lower subframe support comprising a rigid lower longitudinal support extending longitudinally from the head portion of the subframe to the opposing foot portion of the subframe, (iii) a first connector pivotally attached at opposing ends to the upper subframe support and the lower subframe support, and (iv) a second connector pivotally attached at opposing ends to the upper subframe support and the lower subframe support; and
(c) a subframe actuator having a first end mounted to the upper subframe support and a second opposing end mounted to the lower subframe support;
wherein the upper subframe support is adapted to tilt between an inclined position, a flat position, and a declined position when the subframe actuator is activated, causing the first connector to rotate and causing the second connector to rotate.

2. The adjustable foundation of claim 1, wherein:
when the upper subframe support is in a flat position relative to the bottom lower subframe support, the first connector and the lower subframe support together define a first angle therebetween, and the second connector and the lower subframe support together define a second angle therebetween; and
tilting the upper subframe support causes one of the first angle and the second angle to increase and the other to decrease.

3. The adjustable foundation of claim 1, wherein the mattress support surface comprises a first deck support section, and a second deck support section pivotally attached to the first deck support section.

4. The adjustable foundation of claim 3, wherein:
the first connector further comprises a member extending from a body portion of the first connector to a distal end of the member, the distal end of the member being in sliding contact with the first deck support section; and
the first connector member is adapted to raise the first deck support section relative to the upper subframe support when the upper subframe support is tilting toward the inclined position.

5. The adjustable foundation of claim 3, further comprising:
a first actuator having a first end mounted to the first deck support section and a second opposing end mounted to the subframe.

6. The adjustable foundation of claim 3, wherein the first deck support section corresponds to a back and head portion of the mattress support surface, and the second deck support section corresponds to a bottom portion of the mattress support surface.

7. The adjustable foundation of claim 3, wherein the mattress support surface further comprises a third deck support section pivotally attached to the second deck support section, and a fourth deck support section pivotally attached to the third deck support section.

8. The adjustable foundation of claim 7, further comprising:

a first actuator having a first end mounted to the first deck support section and a second opposing end mounted to the subframe.

9. The adjustable foundation of claim 1, further comprising: a mattress positioned above the mattress support surface.

* * * * *